US011957227B2

(12) United States Patent
Kelly

(10) Patent No.: US 11,957,227 B2
(45) Date of Patent: Apr. 16, 2024

(54) HAIR STYLING DEVICE

(71) Applicant: Lisa Marie Kelly, St Augustine, FL (US)

(72) Inventor: Lisa Marie Kelly, St Augustine, FL (US)

( * ) Notice: Subject to any disclaimer, the term of this patent is extended or adjusted under 35 U.S.C. 154(b) by 201 days.

(21) Appl. No.: 16/944,247

(22) Filed: Jul. 31, 2020

(65) Prior Publication Data

US 2021/0030130 A1 Feb. 4, 2021

Related U.S. Application Data

(60) Provisional application No. 62/881,643, filed on Aug. 1, 2019.

(51) Int. Cl.

| | |
|---|---|
| ***A45D 2/24*** | (2006.01) |
| ***A45D 2/36*** | (2006.01) |
| ***A45D 7/00*** | (2006.01) |

(52) U.S. Cl.

CPC ..... *A45D 2/2471* (2013.01); *A45D 2/367* (2013.01); *A45D 7/00* (2013.01)

(58) Field of Classification Search

CPC .... A45D 2/2471; A45D 24/02; A45D 20/525; A45D 20/52; A45D 20/48; A45D 24/22; A46B 9/025; A46B 9/023; A61H 2205/021

USPC ..... D4/133, 128, 127, 136

See application file for complete search history.

(56) References Cited

U.S. PATENT DOCUMENTS

| | | | | |
|---|---|---|---|---|
| 2,272,942 | A * | 2/1942 | Goodwin | A45D 2/14 132/262 |
| 2,609,822 | A | 9/1952 | Mccormack | |
| 3,083,715 | A | 4/1963 | Robert | |
| 3,820,551 | A | 6/1974 | Lanzillotta | |
| 5,191,907 | A * | 3/1993 | Hirzel | A45D 1/18 132/148 |
| D347,085 | S | 5/1994 | Hirzel | |
| 5,638,608 | A * | 6/1997 | Dorber | A45D 20/122 132/118 |
| D394,730 | S | 5/1998 | Olsson | |

(Continued)

FOREIGN PATENT DOCUMENTS

| | | |
|---|---|---|
| EP | 2004004 A1 | 9/2015 |
| GB | 612976 A | 11/1948 |

(Continued)

*Primary Examiner* — Nicholas D Lucchesi
*Assistant Examiner* — Jennifer Gill
(74) *Attorney, Agent, or Firm* — Argus Intellectual Enterprise, LLC; Jordan Sworen; Daniel Enea

(57) ABSTRACT

A hair styling device for styling curly or wavy hair. The hair styling device includes a body and a plurality of tines extending from a proximate end of the body, wherein each of the plurality of tines have a same length as measured from a proximal end to an opposing distal end of a tine. The tines are rigid and non-flexible to facilitate the manipulation and styling of curly hair. In some embodiments, the tines are angled such that the proximal end of the tine extends from a first side of the body and the distal end of the tine is disposed on a second side of the body, wherein the first side and second side are opposite one another. In other embodiments, the tines include an arcuate configuration. The configuration of the tines allows for various manipulation of hair to provide differently styled curls or wavy features.

12 Claims, 8 Drawing Sheets

(56) References Cited

U.S. PATENT DOCUMENTS

| | | | | |
|---|---|---|---|---|
| 6,575,174 | B2 * | 6/2003 | Lee | A46B 9/023 132/148 |
| D533,355 | S * | 12/2006 | Rusk | D28/28 |
| 2006/0102190 | A1 * | 5/2006 | Rusk | A45D 7/02 132/200 |
| 2006/0248667 | A1 * | 11/2006 | Kraemer | A61C 17/34 15/28 |
| 2007/0251537 | A1 * | 11/2007 | De Laforcade | A45D 24/22 132/116 |
| 2008/0178900 | A1 * | 7/2008 | Blyden | A45D 7/02 132/211 |
| 2019/0075921 | A1 * | 3/2019 | Flynn | A46B 11/0086 |

FOREIGN PATENT DOCUMENTS

| | | | |
|---|---|---|---|
| GB | 633291 | A | 12/1949 |
| GB | 2413492 | A | 11/2006 |

* cited by examiner

HAIR STYLING DEVICE

CROSS REFERENCE TO RELATED APPLICATION

This application claims the benefit of U.S. provisional application No. 62/881,643 filed on Aug. 1, 2019; the above identified patent applications are herein incorporated by reference in its entirety.

BACKGROUND OF THE INVENTION

The present invention relates to a hair styling device. The present invention further provides a hair styling device having a body and a plurality of tines extending therefrom for facilitating the curling of hair and conveniently manipulating curly hair.

Combs and brushes are important tools when styling hair. It is often simpler to style straight hair when compared to curly or wavy hair due to the deficiencies of existing hair styling devices. The latter hair types present obstacles to effective hair styling, especially when brushing or combing hair with these typical brushes and combs. Oftentimes, the styling tool can become entangled or knotted within the user's hair during use, negatively effecting the desired hair manipulation. In contrast, a user having straight hair can direct a brush or comb from the base of their hair at the scalp and move it outwardly so as to style and manipulate their hair.

Further, when blow drying hair, individuals with straight hair can easily manipulate their hair with a conventional brush or comb to efficiently dry and style their hair. Individuals with curly hair also use blow dryers to achieve a desired curl or wave style. The desired curl style is difficult to achieve with conventional brushes due to the inability for these brushes or combs to effectively retain or hold strands of hair in a single position while blow drying. This can be due to the short or varying length of tines and the orientation of the tines in a single row.

There exist styling tools for having of a handle with tines extending linearly therefrom. These tines are positioned so that hair can fit between them, however, the tines vary in size and materials. Furthermore, some of these are devices are coupled with heat, either directly from the device or as a blow dryer, to emphasize the curl or wave of the hair as it is styled. These known devices depict brittle or plastic tines that can easily flex or break. The composition and configuration of the known art is incompatible with consistent heat exposure and bends easily under pressure. Because of this, the user does not have entirely free manipulation of the comb.

The present invention relates to a hair styling device for curling hair. The present invention is comprised of a body with a plurality of tines extending from a proximal end of the body. In one embodiment, the tines are all rigid and minimally deflect during use. In this way, the tines manipulate the shape of the hair and produces a more desirable curl or wave to the hair. These tines are of uniform length, terminating the same distance from the base. In use, the user rotates the comb about the longitudinal axis of the body (and tines), causing the hair to curve or curl. A hair dryer may be used to blow hot air to the curled hair to maintain the desired shape.

In light of the devices disclosed in the known art, it is submitted that the present invention substantially diverges in design elements and methods from the known art and consequently it is clear that there is a need in the art for an improvement for hair styling devices. In this regard the instant invention substantially fulfills these needs.

SUMMARY OF THE INVENTION

In view of the foregoing disadvantages inherent in the known types of hair styling devices now present in the known art, the present invention provides a new hair styling device wherein the same can be utilized for effectively and efficiently curling a user's hair.

It is an objective of the present invention to provide a hair styling device comprising a body and a plurality of tines extending from a proximate end of the body, wherein each of the plurality of tines comprise a same length as measured from a proximal end to an opposing distal end of a tine.

It is another objective of the present invention to provide a hair styling device wherein the tines are rigid and non-flexible to facilitate the manipulation and styling of curly hair.

It is yet another objective of the present invention to provide a hair styling device wherein the tines are angled such that the proximal end of the tine extends from a first side of the body and the distal end of the tine is disposed on a second side of the body, wherein the first side and second side are opposite one another. In some embodiments, the distal end of the tines extends to an exterior perimeter of the proximal end of the body from a top planar view thereof.

It is yet another objective of the present invention to provide a hair styling device wherein each tine comprises an arcuate configuration facing a same direction as one another.

It is yet another objective of the present invention to provide a hair styling device wherein the body comprises a first portion and a second portion, wherein the first and second portion taper inward therebetween.

It is therefore an object of the present invention to provide a new and improved hair styling device that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings and reference characters provided therewith.

DETAILED DESCRIPTION OF THE INVENTION

Reference is made herein to the attached drawings. For the purposes of presenting a brief and clear description of the present invention, the preferred embodiment will be discussed as used for receiving and styling curly hair. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1:
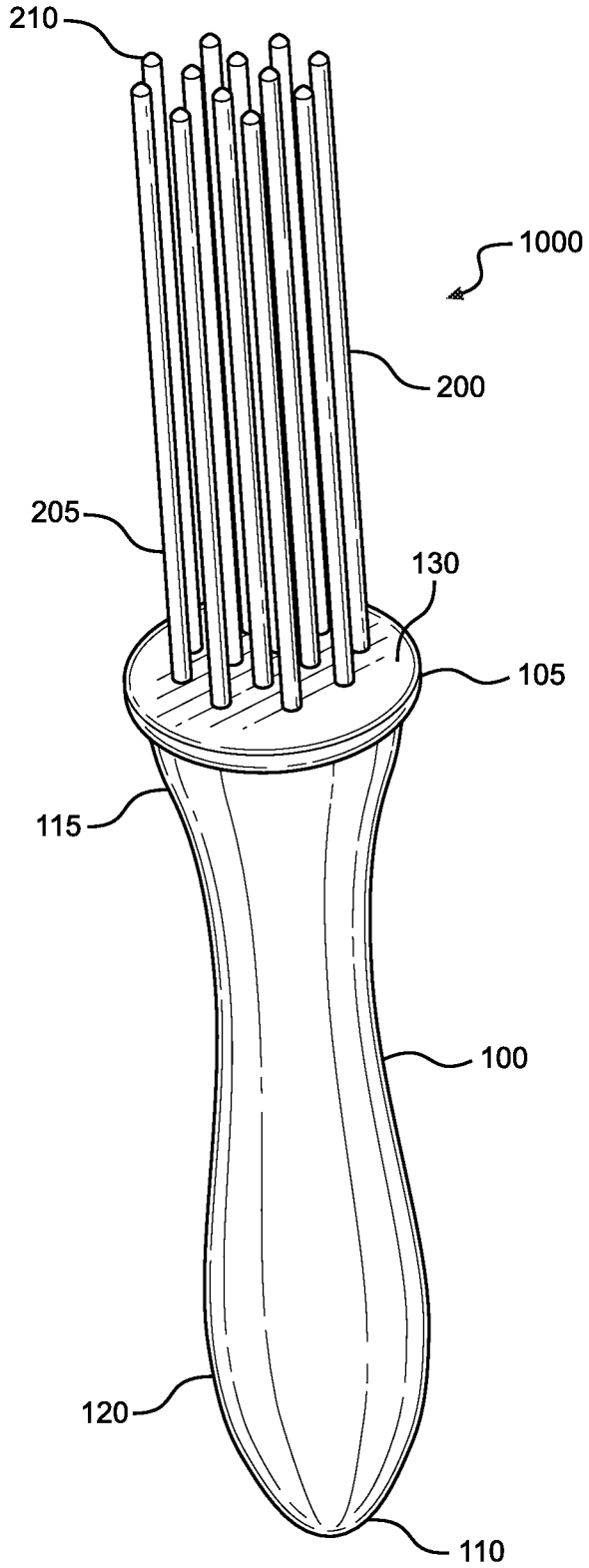
FIG. 1 shows a perspective view of a first embodiment of the hair styling device.
Figure 2:
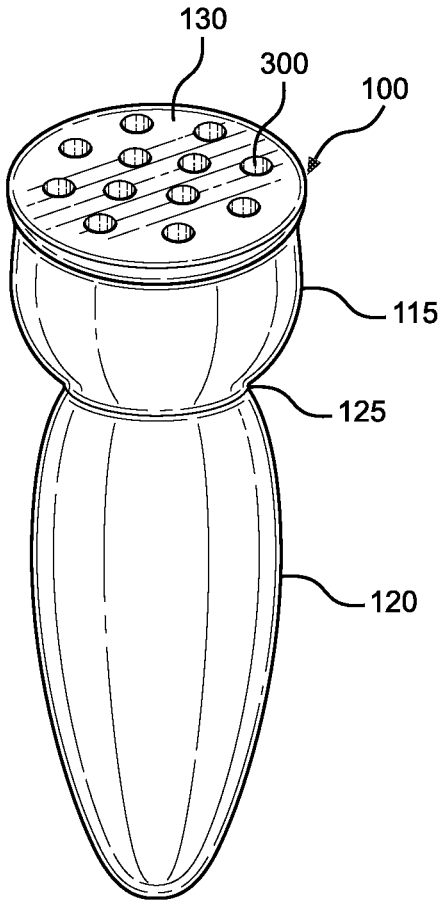
FIG. 2 shows a perspective view of an alternate embodiment of a body of the hair styling device.

Referring now to FIGS. 1 and 2, there is shown a perspective view of a first embodiment of the hair styling device and an alternate embodiment of the body of the hair styling device, respectively. The hair styling device 1000 is used to facilitate the manipulation and styling of curly hair. The hair styling device 1000 comprises a body 100 having a proximate end 105 and an opposing distal end 110, wherein a plurality of tines 200 extend from the proximate end 105. The tines 200 engage with the curls or waves of hair of a user to receive the hair for further manipulation to achieve a particular stylized look, such as tighter curls or looser curls, which is dependent on the shape of tine 200 used and the position of the hair on the tine 200. The body 100 is configured to be grasped by a user to manipulate the hair styling device 1000. In the illustrated embodiment, the body 100 is a monolithic structure comprising a first portion 115 and a second portion 120, wherein the first and second portion 115, 120 tapers inward therebetween. In the illustrated embodiment, the body 100 comprises a circular cross section. However, in alternate embodiments, the body 100 comprises any suitable shape, such as hexagonal, octagonal, or other geometric configurations, adapted to be grasped by the user. In one embodiment, the body 100 is injection molded to form the monolithic structure.

In some embodiments, as seen in FIG. 2, the first portion 115 and the second portion 120 forms a recess 125 configured to receive a thenar webspace of the user, which is an area of skin between the thumb and the index finger. The recess 125 allows a user to wedge his or her hand within the body 100 for a better grip therewith. In the illustrated embodiment of FIG. 2, the first and second portions are bulbous, wherein the first portion 115 comprises a shorter length than the second portion. Length is measured between the proximal and distal ends of the body 100. In other embodiments, as shown in FIG. 1, the taper between the first and second portions is smooth. In some embodiments, the body 100 hollow to allow for lighter weight for weaker individuals. In alternate embodiments, the body is solid in order to provide advanced stability and counterweight to the hair styling device 1000.

Figure 6:
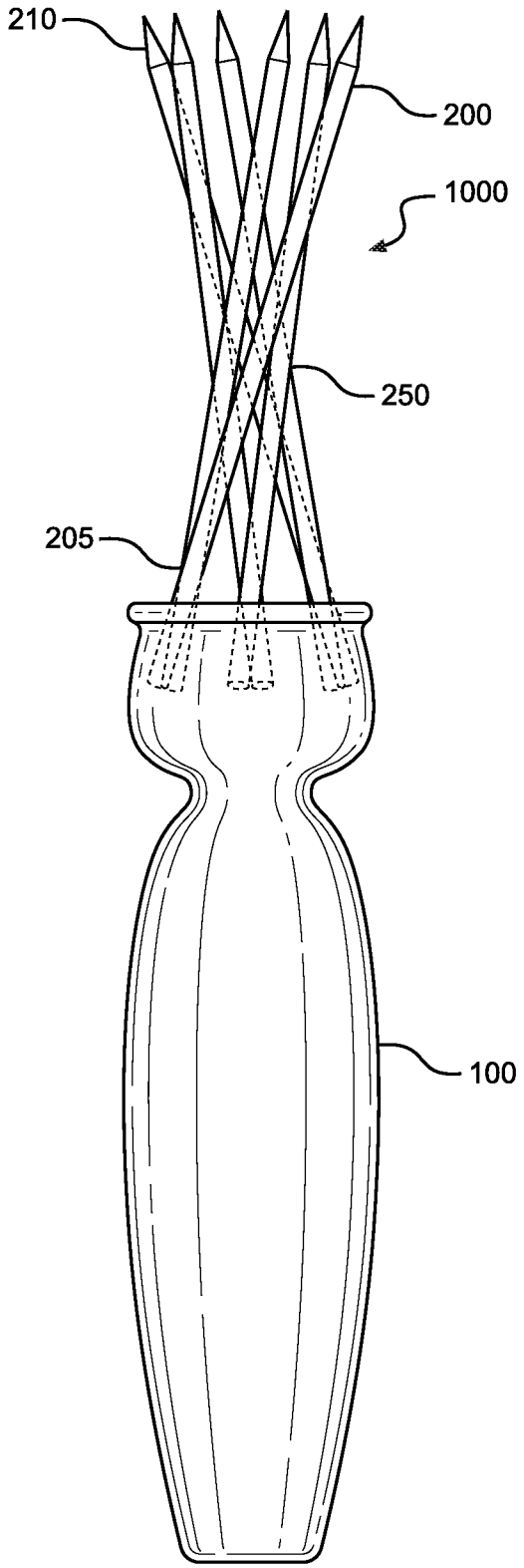
FIG. 6 shows a side view of a fourth embodiment of the hair styling device.

In some embodiments, the body 100 comprises a flat bottom configured to support the hair styling device 1000 in an upright configuration (as seen in FIG. 6). In the illustrated embodiment, the body 100 comprises a length of approximately 5.5 inches, wherein the tines 200 comprises a height of approximately 3.4 inches and a length of approximately 3.67 inches. The ratio of tine to body length is approximately 0.6. However, in alternate embodiments, the ratio of tine to body length varies. In some embodiments, the length of the body is shorter than the length of the tines. In alternate embodiments, the length of the tines is shorter than the length of the body.

In the illustrated embodiment, the body 100 comprises a planar front face 130 having a plurality of apertures 300 disposed thereon. Each aperture 300 receives a tine 200 extending therefrom. In the illustrated embodiment, the apertures 300 only extend in the first portion 115 of the body 100. In alternate embodiments, the tines 200 extend through the first portion 115 and into the second portion 120 to provide additional strength and stability to the tine 200 when in use. In the illustrated embodiment, the plurality of tines 200 is positioned annularly about the front face 130 and at fixed intervals. The uniform spacing allows for even distribution of the hair between and around the tines 200. In some embodiments, the tines 200 comprise regular patterns and in other embodiments the tines comprise an irregular pattern upon the front face of the body.

Figure 3:
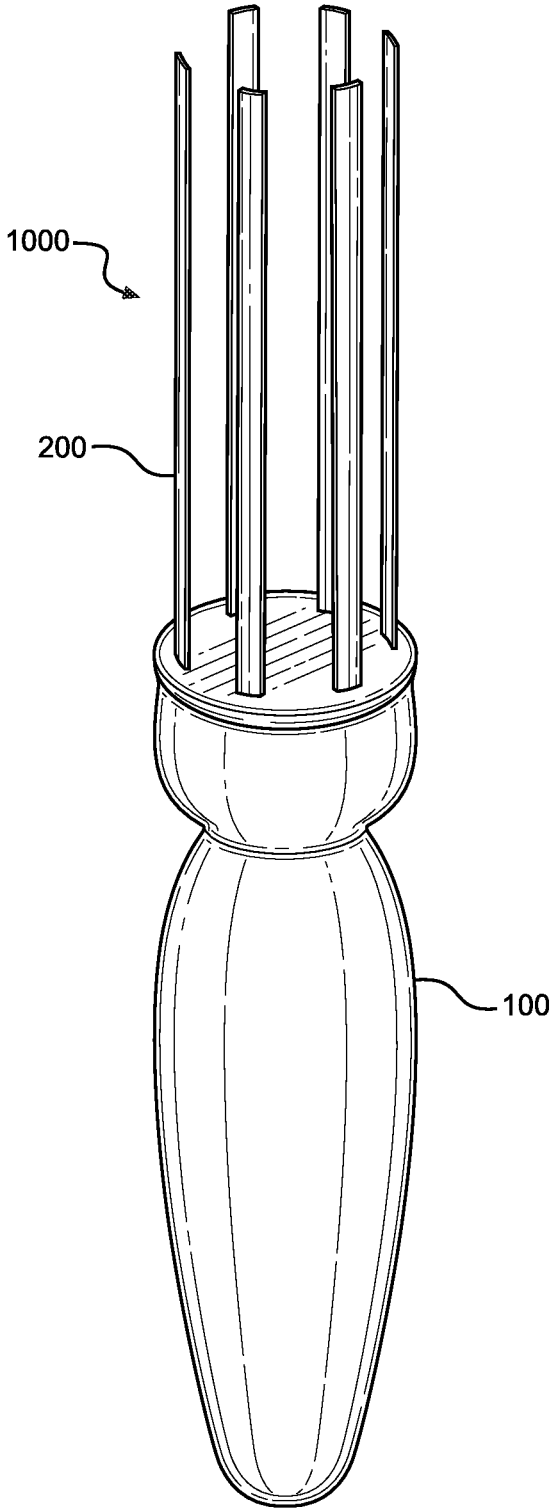
FIG. 3 shows a perspective view of a second embodiment of the hair styling device.
Figure 4:
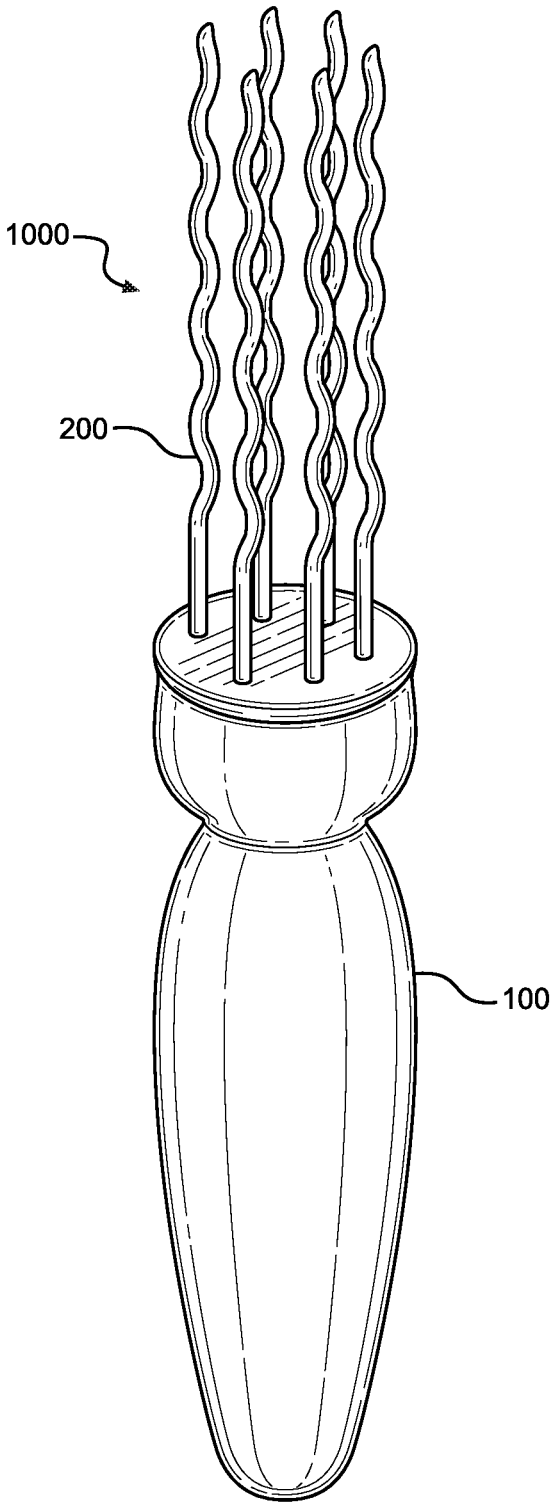
FIG. 4 shows a perspective view of a third embodiment of the hair styling device.

Referring now to FIGS. 1, 3 and 4, there are shown perspective views of different embodiments of the tines of the hair styling device. In the illustrated embodiments, all of the tines 200 are parallel to a longitudinal axis of the body 100 and to every other tine. The tines 200 all comprise a same or uniform length as measured from a proximal end 205 to an opposing distal end 210 of the tine 200. The uniform length of the tines 200 provides for added stability and allows for the hair styling device to efficiently retain all of the strands of hair wrapped therearound while in use, while simultaneously preventing partial removal of strands from the device 1000 if the hair inadvertently moves too close to the distal end 210. In some embodiments, each tine comprises a circular cross section, as illustrated in FIG. 1. In other embodiments, as shown in FIG. 3, the tines 200 have a slight U-shape, such that the exterior of the tine is convex and an interior of the tine 200 is concave. The slight U-shape extends along an entire length of the tine 200. In alternate embodiments, as shown in FIG. 4, the tines 200 comprise an elongated wavy, sinusoidal configuration. The differently shaped tines 200 allow for hair to form to the shape of the tine 200, thereby producing differently styled strands or curls of hair.

Figure 5:
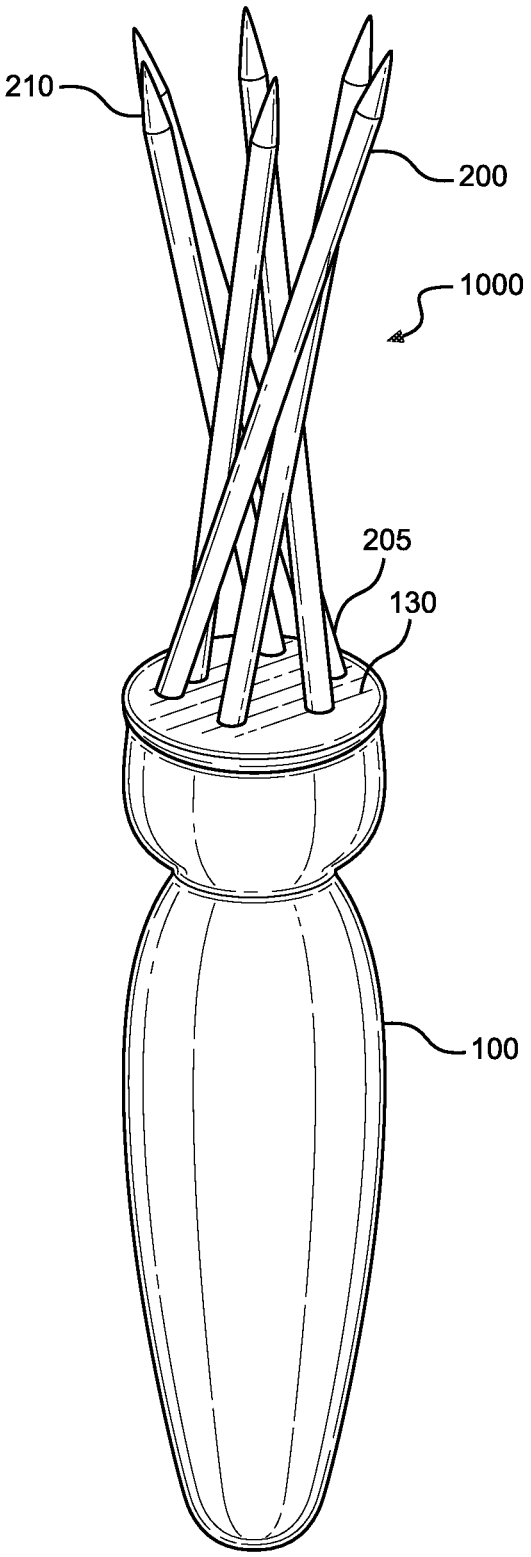
FIG. 5 shows a perspective view of a fourth embodiment of the hair styling device.

In the illustrated embodiment, the distal ends 210 of the tine 200 are rounded. In alternate embodiments, such as shown in FIG. 5, the distal ends 210 of the tines 200 taper to a blunt point, wherein the tapered point facilitates inserting and removing the tines 200 from a user's curly or wavy hair. In one embodiment, each tine 200 is rigid and minimally deflects during use. In this way, the tines 200 manipulate the shape of the hair and produces a more desirable curl to the hair. In some embodiments, the tines 200 are composed of aluminum. However, in other embodiments, the tines 200 are composed of any suitable rigid material, such as another metallic material, either homogenous or designed alloy metallic material to further enhance styling by retaining heat from a blow dryer or other heat source. In some embodiments, the tines are composed of other materials, natural or synthetic; thermoset or thermoplastic type plastics, or ceramic material, or wood, bamboo, woven plant fibers, and the like. The exterior surface of each tine is smooth, regardless of the material, to facilitate insertion and removal of the tines from the user's hair. In this way, the hair will not get caught or entangled in any component of the hair styling device.

Figure 7:
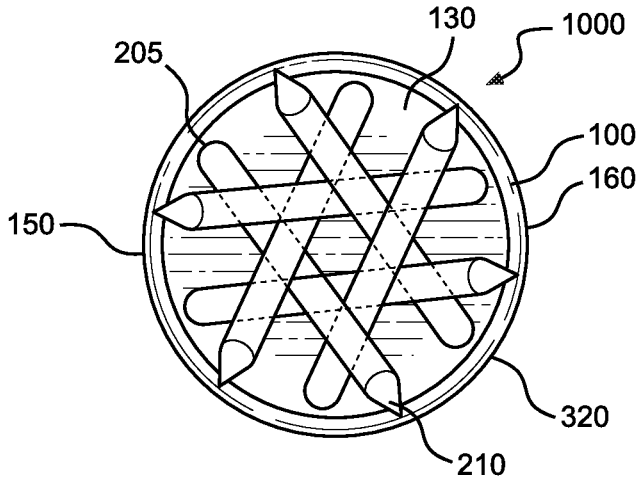
FIG. 7 shows a top planar view of a fourth embodiment of the hair styling device.

Referring now to FIGS. 5-7, there is shown a perspective view, a side view, and a top planar view of a fourth embodiment of the hair styling device, respectively. In the illustrated embodiment, the tines 200 are angled from the flat face 130 of the body 100 such that they extend therefrom at a non-perpendicular angle (when measured at a maximum angle). In one example, a tines 200 is angled such that the proximal end 205 of the tine 200 extends from a first side 150 of the body 100 and the distal end 210 of the tine 200 is disposed on a second side 160 of the body 100, wherein the first side 150 and second side 160 are opposite one another. In some embodiments, the distal end 210 of each tine extends to an exterior perimeter 320 of the proximal end of the body 100 from a top planar view thereof. In the illustrated embodiment, a first tine crosses an adjacent tine at a middle portion 250 disposed between the distal and proximal ends 205, 210 thereof. In the illustrated embodiment, the apertures disposed on the front face are also angled to receive the angled tines therein. In the illustrated embodiment, the tines are permanently secured within the body 100. However, in alternate embodiments, the tines are removable from the apertures and can be replaced by differently shaped tines, such as wavy tines, or redistributed among the apertures to form a different pattern for customized tine configuration. Further, the tines are removable for cleaning or storage purposes.

In the illustrated embodiment, the hair styling device 1000 comprises six tines 200 having a linear length of 3.67 inches, each angled following a right-hand rule. The six tines 200, when viewed from the top planar view, are evenly spaced and positioned at a vertex of a hexagon. In this configuration, the tine 200 forms an angle of between 120 degrees and 180 degrees, when measured from a tangent line at the proximal end of the tine. For example, if the proximal end of each tine was assigned a number (1)-(6) arranged sequentially clockwise, then as shown, the distal end of the tine (1) terminates between tines (3) and (4), thereby forming an angle of between 120 degrees and 180 degrees. In one embodiment, the tine (1) bisect the tines (3) and (4) forming an angle of 150 degrees. Moreover, the tine (1) forms an angle of elevation of between 65 degrees and 70 degrees when the maximum angle is measured between the front face and the tine (1), when viewed at the side view (see FIG. 4). The angle of elevation may alter depending on the relative length of the tines 200.

Figure 8:
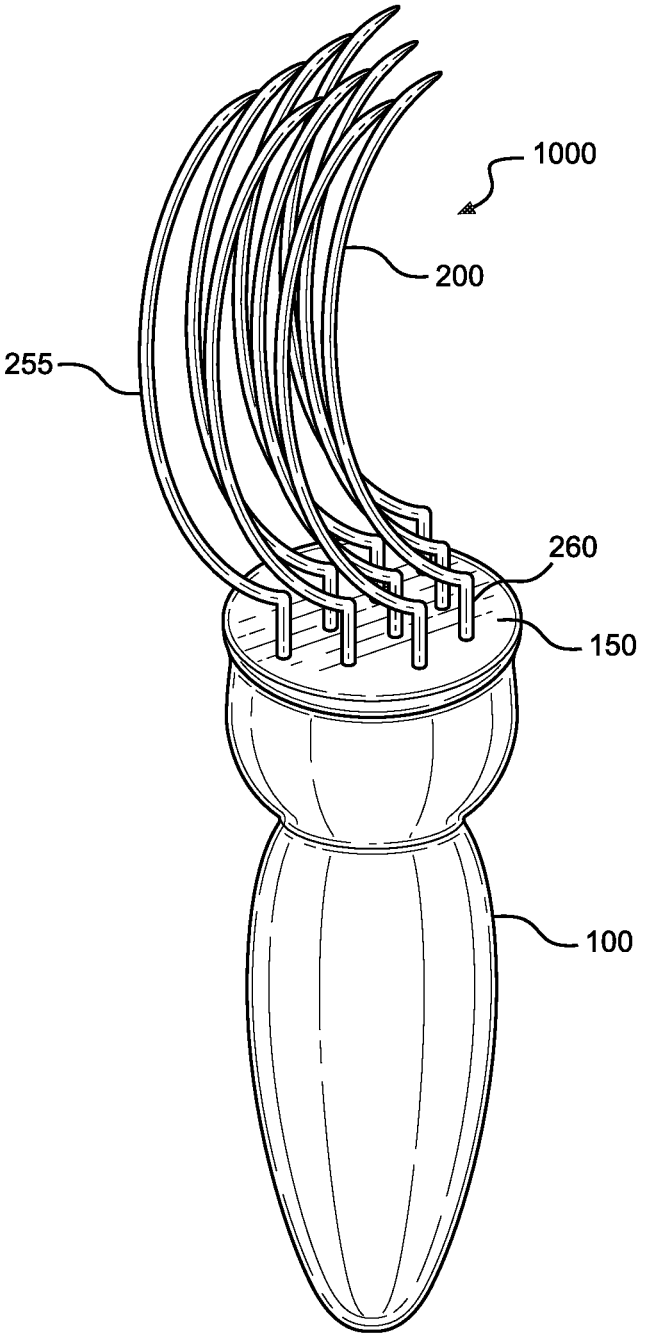
FIG. 8 shows a perspective view of a fifth embodiment of the hair styling device.
Figure 9:
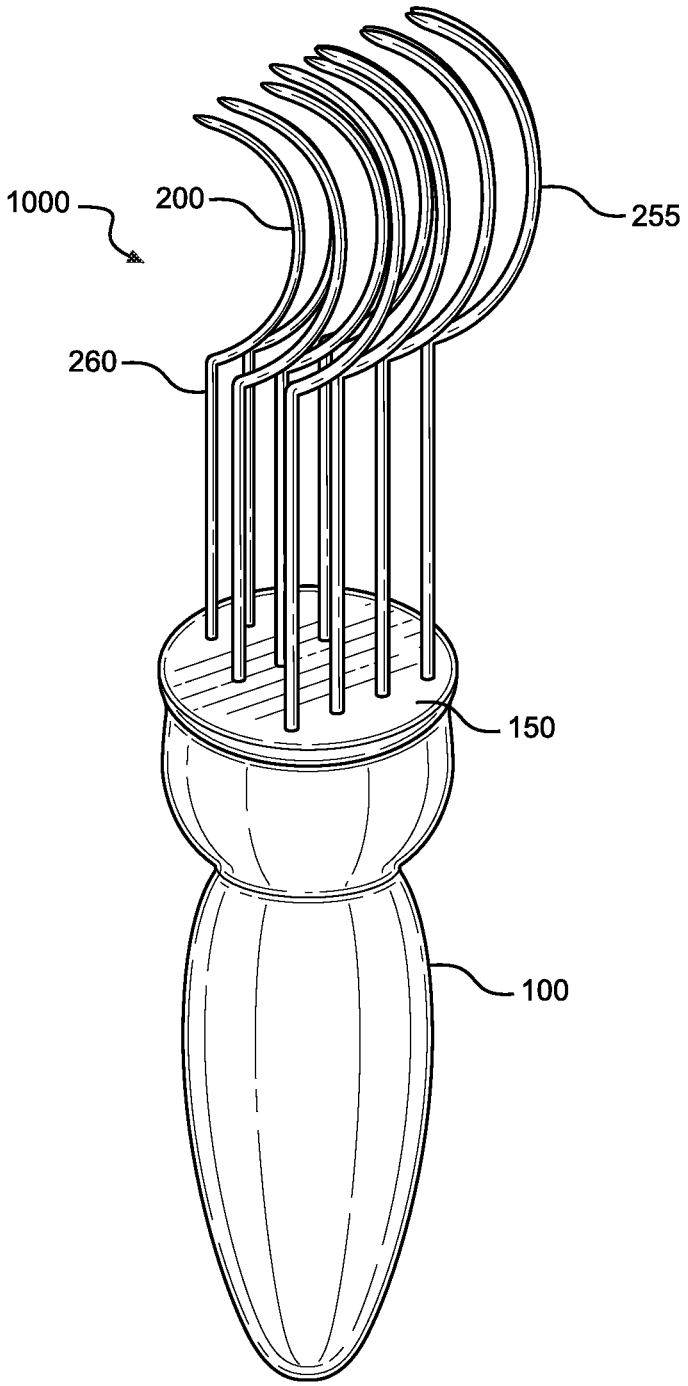
FIG. 9 shows a perspective view of a sixth embodiment of the hair styling device.

Referring now to FIGS. 8 and 9, there are shown perspective views of a fifth and sixth embodiment of the hair styling device, respectively. In the illustrated embodiment of the hair styling device 1000, each tine 200 comprises an arcuate configuration. Each tine 200 faces a same direction as one another. In some embodiments, the tines 200 comprises a linear portion 260 extending directly from the body 100 and the arcuate configuration or curve 255 of the tine extends directly from the linear portion 260 thereof. The tines are not evenly distributed along the front face of the body, but instead disposed in a pattern of rows. In some embodiments, the number of tines in each row decreases from the first side of the body 100 to the second side thereof. This configuration provides for use of the hair styling device 1000 in a particular manner in which a user grasps the body 100 and in a scooping motion picks up the strands of hair to be manipulated. In some embodiments, such as illustrated in FIG. 8, the curve 255 forms the majority of the length of the tine 200. However, in other embodiments, such as shown in FIG. 9, the linear portion 260 comprises a majority of the length of the tine, whereas the curve 255 forms a minority of the length of the tine. In this way, if the curve 255 is larger, the curl formed by the tine will also be larger.

Figure 10:
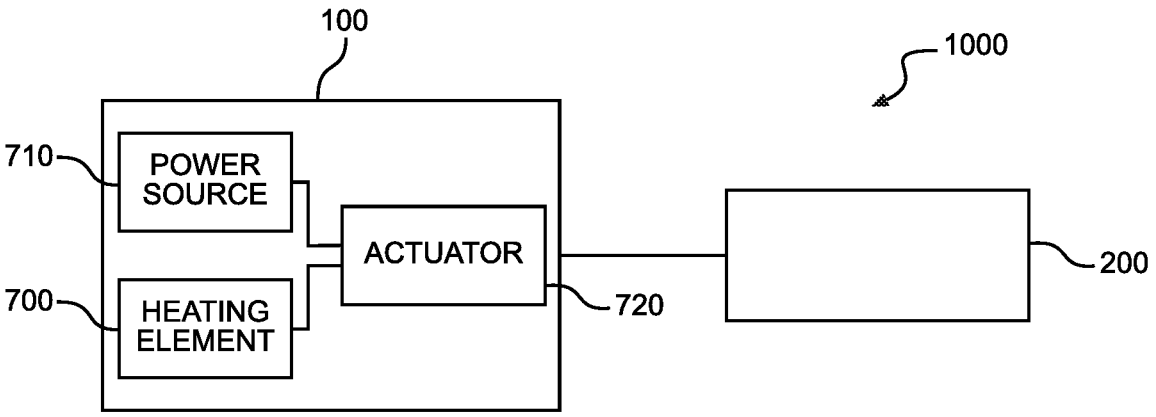
FIG. 10 shows a block diagram of an embodiment of the hair styling device.

Referring now to FIG. 10, there is shown a block diagram of an embodiment of the hair styling device. In some embodiments, the tines 200 are coupled to a power source 710 and a heating element 700 disposed within the body 100 to supply heat thereto. The heating element 700 causes the tines 200 to increase in temperature, wherein the heated tines 200 allow a user to more easily curl and style their hair. An actuator is operably connected to the heating element 700 and power supply 710 to allow a user to selectively activate the heating function. In some embodiments, the actuator 720 comprises a switch or button disposed on an exterior of the body that allows the heating element to turn on and off. In the illustrated embodiment, the power supply 710 is a battery. In alternate embodiments, power is supplied to the heating element through an electrical cord extending from the body and configured to plug into an electrical outlet.

Figure 11:
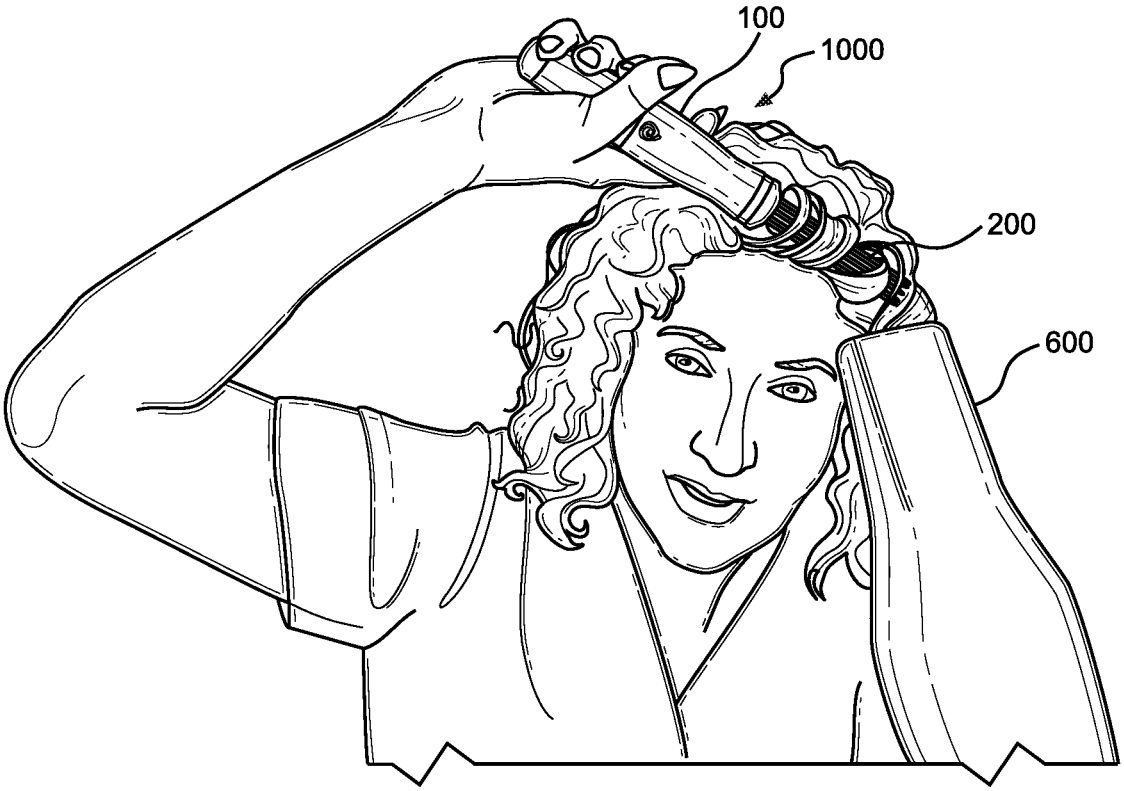
FIG. 11 shows a perspective view of an embodiment of the hair styling device in use.
Figure 12:
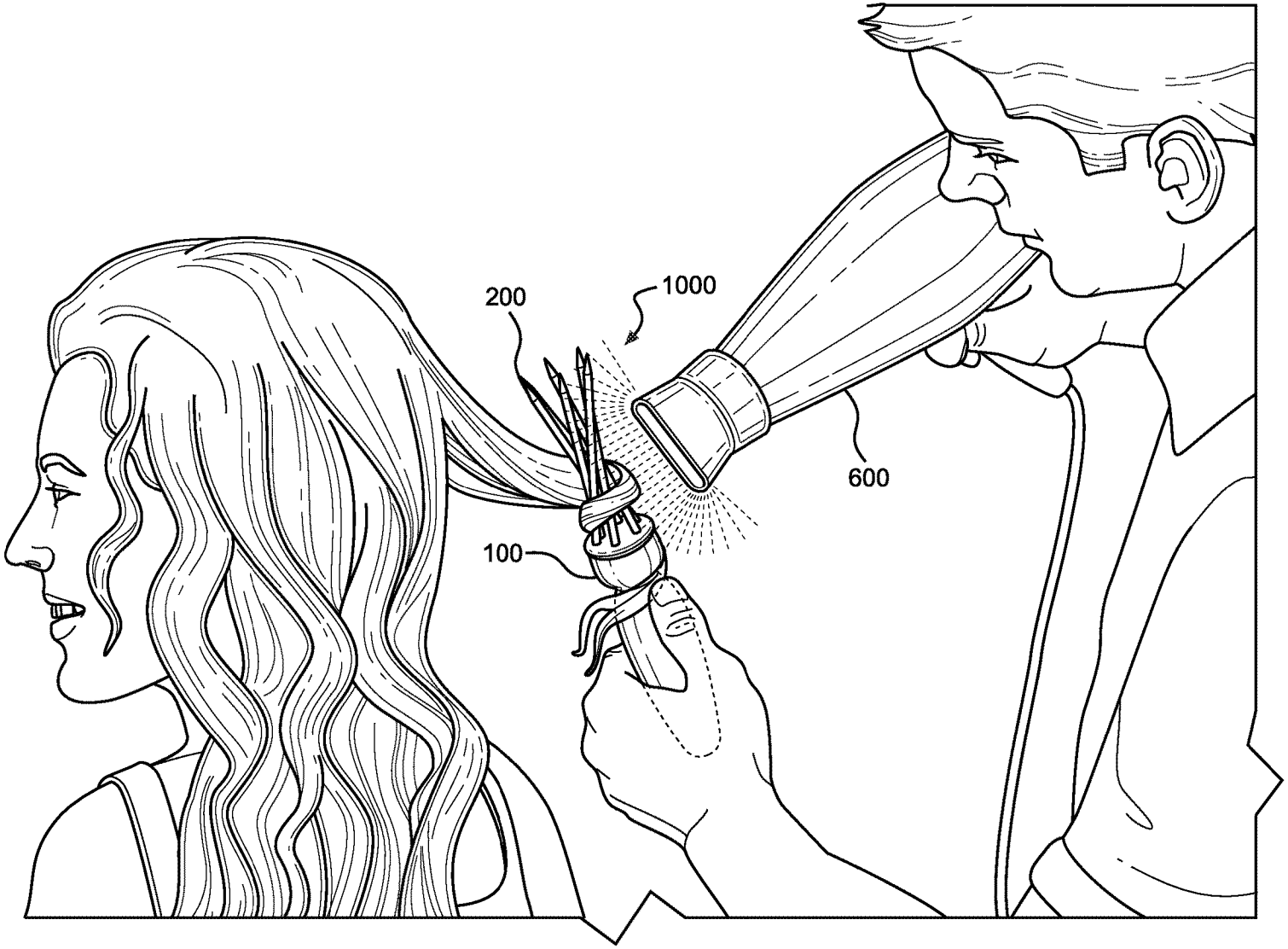
FIG. 12 shows a perspective view of another embodiment of the hair styling device in use.

Referring now to FIGS. 11 and 12, there are shown perspective views of the hair styling device in use. In the illustrated embodiment, the plurality of tines 200 is positioned annularly about the front face and at fixed intervals. The uniform spacing allows for even distribution of the hair between and around the tines 200. In use, the tines are placed in a section of hair while the user holds the body, brushing and turning it to produce the desired styling. In this way, the hair is positioned through the gaps formed between adjacent tines and extends pass at least two gaps. In use, the user rotates the device about the longitudinal axis of the body (and tines), causing the hair to curve or curl. A hair dryer 600 may be used to blow hot air to the curled hair to maintain the desired shape. The configuration of the tines allows for the hair styling device to be inserted anywhere along a user's hair, such as at the root of the hair, and rotated to gather the hair around the tines. Once the hair is sufficiently curled, the tines can easily be removed from the hair by sliding the device along the same longitudinal axis in which the device was rotated. The configuration of the device allows the user to effectively lift and manipulate a volume of hair with a focus on a particular area, specifically at the roots, without causing any entanglement when removing the device from the hair.

In some uses, the tines 200 of the hair styling device 1000 are inserted within a user's hair and lifts the hair such that the hair moves from the distal end to the proximate end 205, below the middle portion 250. When the hair is positioned below the middle portion, wherein the adjacent tines 200 intersect, the hair is more secured within the device 1000 and intertwined with the tines. As the hair moves towards the proximate end of the tines 200 a larger or wavy curl is achieved. If the user manipulates or dries the hair closer toward the middle portion 250 of the tines 200, a tighter curl is achieved. This is a result of the changing diameter along the length of the hair styling device 1000 due to the angled and annularly placed tines 200.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair styling device, comprising:

a body having a proximate end and an opposing distal end, and a planar front face perpendicular to a longitudinal axis of the body;

a plurality of tines extending from the planar front face disposed at the proximate end of the body in a substantially annular configuration;

wherein each of the plurality of tines comprise a same length as measured from a proximal end to an opposing distal end of the tine;

wherein the distal end of each tine extends inward towards an exterior perimeter of an opposing side of the body and at an angle offset from the longitudinal axis, such that a pair of adjacent tines of the plurality of tines cross one another;

wherein the planar front face is fixed and nonrotatable relative to the body;

wherein the plurality of tines are configured to engage with hair and lift the hair away from a head of a user by rotating the handle about the longitudinal axis in a first direction to wrap the hair against two or more tines of the plurality of tines;

wherein the plurality of tines are configured to release the hair from the two or more tines of the plurality of tines by rotating the handle about the longitudinal axis in a second direction, wherein the first direction is opposite the second direction;

wherein each tine is rigid and non-flexible.

2. The hair styling device of claim 1, wherein the proximate end of the body comprises apertures that removably receive the proximal end of each tine of the plurality of tines, such that each tine is removable therefrom.

3. The hair styling device of claim 1, wherein the body comprises a first portion joined to a second portion, wherein the first portion and the second portion are each bulbous and cooperatively form a taper therebetween.

4. The hair styling device of claim 1, wherein each tine extends at a same non-perpendicular angle from the proximate end of the body.

5. The hair styling device of claim 4, wherein the proximate end of the body comprises a plurality of apertures, wherein each aperture is adapted to removably receive the proximate end of each tine of the plurality of tines.

6. The hair styling device of claim 1, wherein the distal ends of all of the plurality of tines form an annular ring when viewed from a top planar view thereof.

7. The hair styling device of claim 6, wherein the distal end of each tine extends to an exterior perimeter of the proximate end of the body from the top planar view thereof.

8. The hair styling device of claim 7, wherein the body comprises a first portion joined to a second portion, wherein the first portion and the second portion are each bulbous and cooperatively form a taper therebetween.

9. The hair styling device of claim 7, wherein each tine forms an angle of elevation of between 65 degrees and 70 degrees when a maximum angle is measured between the planar front face and the tine.

10. The hair styling device of claim 1, wherein each tine of the plurality of tines comprise an elongated wavy, sinusoidal configuration;

wherein the body comprises a first portion joined to a second portion, wherein the first portion and the second portion are each bulbous and cooperatively form a taper therebetween.

11. The hair styling device of claim 1, wherein the distal end of the body comprises an entirely flat bottom configured to support the hair styling device in an upright configuration.

12. The hair styling device of claim 1, wherein each tine crosses more than one other tine of the plurality of tines.

* * * * *